US011377846B2

(12) United States Patent
Hanson

(10) Patent No.: US 11,377,846 B2
(45) Date of Patent: Jul. 5, 2022

(54) BEAM AND BOLTING CONSTRUCTION SYSTEM AND METHOD

(71) Applicant: Stephen Hanson, Ben Lomond, CA (US)

(72) Inventor: Stephen Hanson, Ben Lomond, CA (US)

(73) Assignee: Stephen D. Hanson, Ben Lomond, CA (US)

( * ) Notice: Subject to any disclaimer, the term of this patent is extended or adjusted under 35 U.S.C. 154(b) by 0 days.

(21) Appl. No.: 17/095,181

(22) Filed: Nov. 11, 2020

(65) Prior Publication Data

US 2021/0062504 A1 Mar. 4, 2021

Related U.S. Application Data

(63) Continuation of application No. 15/986,605, filed on May 22, 2018, now abandoned.

(Continued)

(51) Int. Cl.

*E04B 2/70* (2006.01)
*E04B 2/06* (2006.01)

(Continued)

(52) U.S. Cl.

CPC ..... *E04B 2/702* (2013.01); *E04B 2/06* (2013.01); *E04B 2/704* (2013.01); *E04B 2001/3583* (2013.01); *E04B 2002/0254* (2013.01)

(58) Field of Classification Search

CPC . E04B 2/06; E04B 2/702; E04B 2/704; E04B 2001/3583; E04B 2001/0254

See application file for complete search history.

(56) References Cited

U.S. PATENT DOCUMENTS 729,408 A * 5/1903 Pickin ..... E04B 1/06 52/223.7
2,563,703 A * 8/1951 Bonney ..... E04B 2/702 52/233

(Continued)

FOREIGN PATENT DOCUMENTS

WO 9109513 A2 7/1991
WO WO-9109513 A2 ‡ 7/1991 ..... E04B 2/702

OTHER PUBLICATIONS

International Search Report for PCT/US2018/044528 dated Oct. 25, 2018.‡

(Continued)

*Primary Examiner* — James M Ference

(74) *Attorney, Agent, or Firm* — Klintworth & Rozenblat IP LLP

(57) ABSTRACT

A beam and bolting construction method and an example dwelling (10) according to the method are provided. The method involves preliminary steps of selecting a site and determining a bolt array (19) and selection of dimensions and materials. Actual construction steps include forming a foundation slab (14) having vertical bolts (18) embedded therein in accordance with the bolt array (19). Alternating layers of beams (B), having aligned bolt bores (52) for receiving the bolts, are successively laid down over the bolts (18), with sides meeting at corners (29) with alternating sides encompassing the corner bolt. Once a desired height is achieved, washers (72) and nuts (78) are placed on the bolts and are tightened to desired pressure levels. The dwelling (10) is formed with beams (42) compressed together by threaded bolts (18) in a bolt array (19).

7 Claims, 9 Drawing Sheets

Related U.S. Application Data

(60) Provisional application No. 62/539,546, filed on Aug. 1, 2017.

(51) Int. Cl.
*E04B 2/02* (2006.01)
*E04B 1/35* (2006.01)

(56) References Cited

U.S. PATENT DOCUMENTS 3,343,328 A * 9/1967 Rolle ..... E04B 2/704 52/605
3,449,875 A * 6/1969 Elmer ..... E04B 2/704 52/223.7
4,089,144 A * 5/1978 Astl ..... E04B 2/706 52/281
4,305,238 A * 12/1981 Harward ..... E04B 2/702 428/17
4,353,191 A * 10/1982 Schilbe ..... E04B 2/702 52/233
4,463,532 A * 8/1984 Faw ..... E04B 1/10 52/233
4,503,648 A * 3/1985 Mahaffey ..... E04B 2/709 52/223.7
4,510,724 A * 4/1985 Magnuson ..... E04B 2/702 52/233
4,688,362 A * 8/1987 Pedersen ..... E04B 2/08 52/223.7
4,745,722 A * 5/1988 Ross ..... E04B 2/702 52/233
4,777,773 A * 10/1988 Fry ..... E04B 1/18 52/220.2
4,823,528 A * 4/1989 Faw ..... E04B 2/702 52/233
5,010,701 A * 4/1991 Halsey, Jr. ..... E04B 2/702 52/233
5,115,609 A * 5/1992 Sing ..... E04C 3/14 52/309.9
5,253,458 A * 10/1993 Christian ..... E04B 2/56 52/223.7
5,471,804 A * 12/1995 Winter, IV ..... E04B 1/14 403/231
5,570,549 A * 11/1996 Lung ..... E04H 9/14 52/295
5,657,597 A * 8/1997 Loftus ..... E02D 27/01 52/274
5,787,675 A * 8/1998 Futagi ..... E04B 2/702 411/389
5,806,249 A * 9/1998 Helms ..... E02D 29/02 52/102
5,881,515 A * 3/1999 George ..... E04B 1/34326 52/233
5,890,332 A * 4/1999 Skidmore ..... E04B 2/08 52/271
5,899,040 A * 5/1999 Cerrato ..... E04B 2/10 52/604
6,000,177 A * 12/1999 Davidson ..... E04B 2/709 52/233
6,023,895 A * 2/2000 Anderson ..... E04B 2/702 52/233
6,161,339 A * 12/2000 Cornett, Sr. ..... E04H 9/14 52/23
6,195,949 B1 * 3/2001 Schuyler ..... E04H 9/14 52/223.13
6,385,929 B1 * 5/2002 Englehart ..... F16B 7/18 52/233
6,588,161 B2 * 7/2003 Smith ..... E04B 2/702 52/93.2
6,931,803 B1 * 8/2005 Davis ..... E04B 1/28 52/251
7,117,647 B2 * 10/2006 Clarke ..... E04B 2/702 52/233
7,549,263 B1 * 6/2009 Porter ..... E04B 1/14 52/127.7
7,661,230 B2 * 2/2010 Peaco ..... E04B 2/702 52/233
8,387,338 B1 * 3/2013 Smith ..... E04F 15/08 52/745.09
8,601,761 B2 12/2013 Chadwick
8,701,364 B2 * 4/2014 Wrightman ..... E04B 2/702 52/233
9,428,926 B2 * 8/2016 Kramer ..... E04B 2/08
2002/0043038 A1 * 4/2002 Cerrato ..... E04C 5/08 52/604
2002/0046519 A1 * 4/2002 Houseal ..... E04B 2/702 52/233
2002/0124524 A1 * 9/2002 Lokken ..... E04B 2/02 52/747.1
2002/0157334 A1 * 10/2002 Smith ..... E04B 2/702 52/233
2003/0230032 A1 * 12/2003 Shahnazarian ..... E04H 9/14 52/167.3
2004/0134142 A1 * 7/2004 Stutts ..... E04B 2/702 52/233
2004/0187411 A1 * 9/2004 Clegg ..... E04B 2/702 52/233
2005/0081465 A1 * 4/2005 Crumley ..... E04H 9/14 52/223.1
2005/0126084 A1 * 6/2005 Woksa ..... E04B 2/702 52/79.1
2006/0248825 A1 * 11/2006 Garringer ..... E04B 2/705 52/233
2008/0072508 A1 * 3/2008 Tower ..... F16F 1/12 52/223.13
2008/0083177 A1 * 4/2008 Tiberi ..... B29C 44/1233 52/233
2009/0133345 A1 * 5/2009 Wrightman ..... E04B 2/702 52/233
2009/0199497 A1 * 8/2009 Wrightman ..... E04B 2/705 52/233
2009/0293390 A1 * 12/2009 Anderson ..... E04B 2/702 52/233
2010/0186316 A1 * 7/2010 Buchanan ..... E04B 1/10 52/167.1
2011/0239565 A1 * 10/2011 Clarke ..... E04B 2/702 52/233
2012/0031025 A1 * 2/2012 Cox ..... E04B 2/702 52/220.1
2013/0081343 A1 * 4/2013 Chadwick ..... E04B 2/702 52/223.14
2013/0175427 A1 * 7/2013 Moyher ..... E02D 27/02 249/18
2014/0326359 A1 * 11/2014 Bennett ..... B63B 3/04 141/1
2015/0184377 A1 * 7/2015 Stein ..... E04B 2/58 52/233
2016/0194869 A1 * 7/2016 Thornton ..... E04B 2/702 52/233
2017/0096813 A1 * 4/2017 Thornton ..... E04B 2/702
2019/0040629 A1 * 2/2019 Hanson ..... E04B 2/702
2019/0119876 A1 * 4/2019 Grussenmeyer ..... E04C 5/06
2021/0062504 A1 * 3/2021 Hanson ..... E04B 2/06

OTHER PUBLICATIONS

International Search Report and Written Opinion for PCT Application No. PCT/US2021/062425 dated Jan. 11, 2022, 15 pages.

* cited by examiner
‡ imported from a related application

BEAM AND BOLTING CONSTRUCTION SYSTEM AND METHOD

This is a continuation patent application, claiming priority from non-provisional application Ser. No. 15/986,605, filed May 22, 2018, claiming priority from Ser. No. 62/539,546, by the same inventor, filed Aug. 1, 2017.

TECHNICAL FIELD

The present invention relates generally to construction methods and system apparatus for uniform cross-section beam and bolting construction, particularly as applied to single story dwellings.

BACKGROUND ART

Like nearly all other areas of knowledge and commerce, the field of dwelling construction is subject to continual improvements in techniques, use of materials, and related structural designs. This is certainly the case in the construction of dwelling such as cabins and small houses.

Although the concept of wooden dwellings goes back into prehistory, these have always been subject to problems, both in the construction methods and in the resulting products. For example, traditional "log cabins" were difficult in finding sufficiently uniform logs and requiring caulking materials (often requiring frequent renewal) to protect the inhabitants from the elements.

Wood constructions have many advantages, particularly since natural woods, with the exceptions of some hardwoods, have at least some degree of flexibility and compressibility. This allows for better weather sealing, and for better resistance to earthquake and wind damage. Better methods of improving these aspects are highly desirable.

Accordingly, there is significant room for improvement and a need for stronger and more easily constructed walls and frames for buildings.

DISCLOSURE OF INVENTION

Accordingly, it is an object of the present invention to provide a method for constructing beam and bolting vertical walls.

Another object of the invention is to provide a method and protocol for building cabins and other buildings utilizing preformed wood beams.

A further object of the present invention is to provide for walls which are held together with adjustable pressure bots and nuts.

Yet another object of the invention is to provide secure comers in beam construction.

A further object of the present invention is to provide cabins and other buildings which are sturdy and resistant to elemental degradation.

Still another object of the invention is to provide a structure which is extremely stable in response to high winds, earthquakes, and other destructive forces.

A further object is to create a structure which utilizes a virtual lamination technique, a "Bolt-Lam" to maintain beam members in a pressure abutment structure which has synergistic advantages in weather sealing, combined strength, and durability.

Another object of the invention is that all intersecting walls are multidirectional shear walls, highly resistant to deformation of any kind.

Briefly, one preferred embodiment of the present invention is a method (M) for constructing beam and bolting walls and structures. The method involves preliminary steps of selecting a site and determining a bolting array and selection of dimensions and materials. Actual construction steps include forming a foundation slab having vertical bolts embedded therein in accordance with the bolting array. Alternating layers of beams, having aligned bolt holes for receiving the bolts, are successively laid down over the bolts, with sides meeting at comers with alternating sides encompassing the comer bolt. Once a desired height is achieved, washers and nuts are placed on the bolts and are tightened to desired pressure levels. The nuts and threaded bolt ends are situated to have an access gap such that the pressure may be adjusted as conditions change. The method and protocol may be used in forming structures such as cabins, houses, outbuildings and the like.

Other preferred embodiments are product by process structures constructed in accordance with the method (M).

An advantage of the present invention is that it provides a relatively rapid and secure protocol for raising a set of walls.

Another advantage of the invention is that it provides for constructing a building which may be made with preformed beams, having spaced-apart bolt holes for receiving vertical bolts.

An additional advantage of the invention is that embedding elongated threaded bolts in a foundation slab provides an array upon which beams may be vertically installed thereon.

A further advantage of the construction method (M) is that the "Bolt-Lam" virtual lamination by pressure has a synergistic effect superior to prior art techniques.

Yet another advantage of the present invention is that the structure is much stronger and sturdier than one created with conventional stick framing.

Still another advantage of the present invention is that the intersecting walls together form a moment frame for the entire building.

A further advantage of the present invention is that a completed frame is integral and very highly resistant to separation of a portion thereof by forces such as wind.

These and other objects and advantages of the present invention will become clear to those skilled in the art in view of the description of the best presently known modes for carrying out the invention and the industrial applicability of the preferred embodiments as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
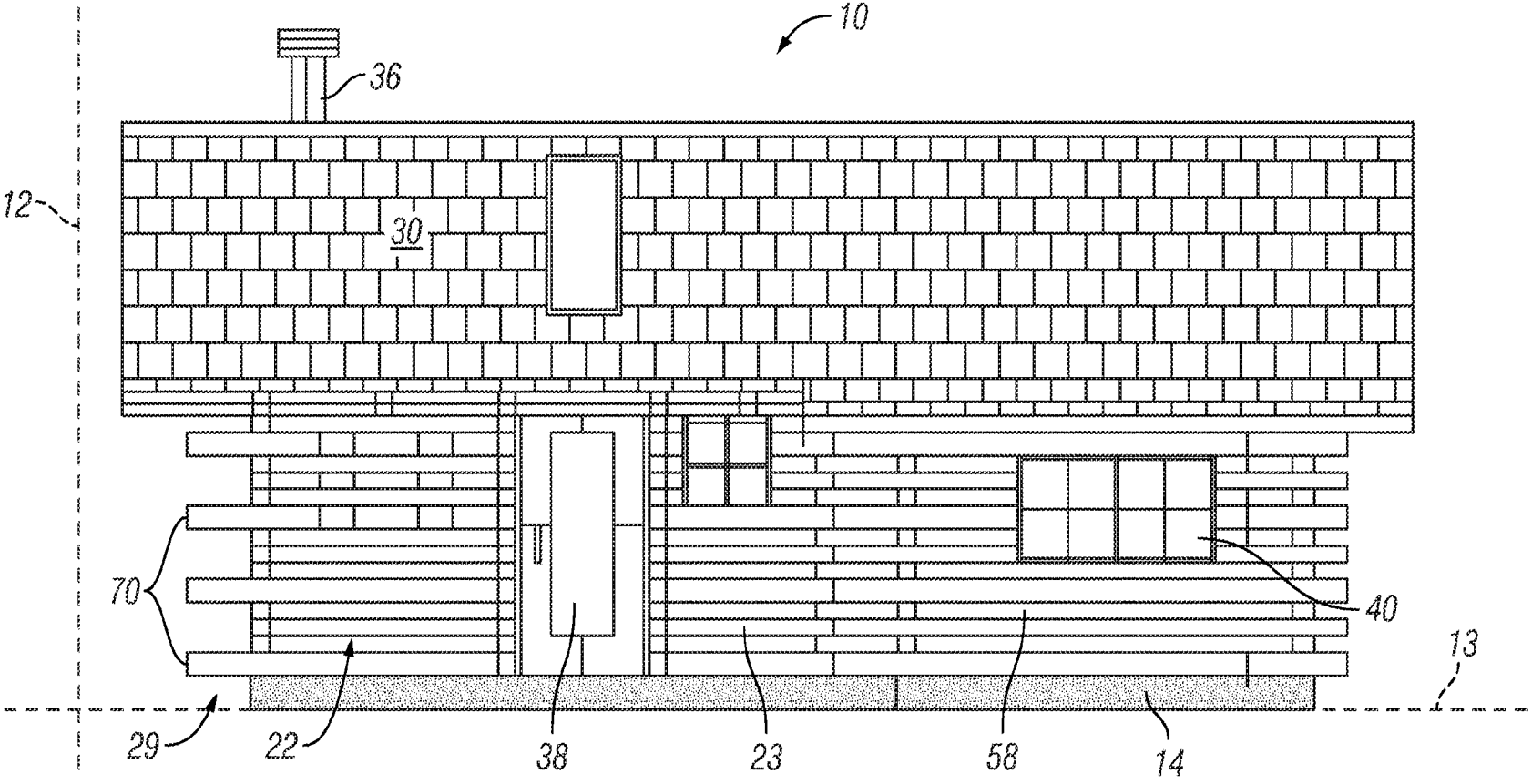
FIG. 1 is a front plan view of an example dwelling constructed in accordance with the present invention.

The present invention is a method of construction (M) for dwellings and other buildings utilizing beam and bolting and of the structures resulting therefrom. An example dwelling 10, in this case a cedar or redwood beam cabin, is illustrated in a front view of FIG. 1. The structure is defined in terms of the spatial relationships (shown in phantom) including a primary vertical plane 11, a transverse vertical plane 12 perpendicular to the primary plane 11, and a horizontal plane 13 perpendicular to the vertical planes.

The preferred process (M) involves a series of steps in constructing and maintaining a beam and bolting building/dwelling. A brief summary of the steps is set forth below:

Select site and prepare layout, including bolting array positioning;

Locate comers for bolting on foundation slab;

Precisely locate bolt anchor locations for foundation slab;

Determine height of walls;

Select locations for gaps in walls (doors, windows, etc.);

Determine whether corners will have extended beam segments and sequential order of beam vertical overlap at corners;

Select materials;

Choose gauge and length of vertical bolts and choose nuts and washer plates;

Choose materials for beams (e.g. cedar, redwood, composite, etc.);

Determine cross-sectional structure of beams;

Determine default beam length;

Prepare foundation slab;

Situate and secure vertical bolts in predetermined bolt anchor locations defined by the bolting array;

Construct foundation slab to provide a flat upper surface and secure vertical bolt in precise vertical orientation;

Prepare beams;

Provide bolt bores through each beam in accordance with spacing of the predetermined vertical bolt locations;

Cut beam segments (truncated beam segments) to accommodate corners and wall gaps according to plans;

Vertically lower first beam in comer overlap sequence (cross beam) onto respective vertical bolts, including the selected corner bolt and at least one interstitial bolt, through respective bolt bores until it rests upon the foundation slab, with, if selected, extending beyond the corner bolt;

Vertically lower second beam in the corner overlap sequence (truncated transverse beam) onto respective interstitial vertical bolts such that it rests upon the foundation slab with a beam end abutting against the cross beam at the corner;

Repeating steps set forth in the two immediately preceding paragraphs, inserting bolt couplings and additional bolt segments as required, until all comers are completed;

If necessary, laying down beam segments on interstitial bolts to fill in any gaps not corresponding to doors, or the like in the layer;

Laying down additional layers until the desired wall heights are achieved, alternating the functions of the cross beam and the transverse beam in each successive layer such that the comer bolts alternatively pass through cross and transverse beams;

Upon achieving desired wall height:

Laying down washer plates (pressure distribution plates) encompassing each of the vertical bolts on top of the beams; and Applying and tightening nuts to each of the treaded bolts to force all of the beams together to a desired pressure (creating a "Bolt-Lam") in order to achieve a desired "seal" and a secure structure.

Installing a desired roof above the walls, maintaining an access gap above all bolts and nuts to allow subsequent pressure adjustment.

Oher steps, which are not critical to the present invention, may also be performed.

Figure 2:
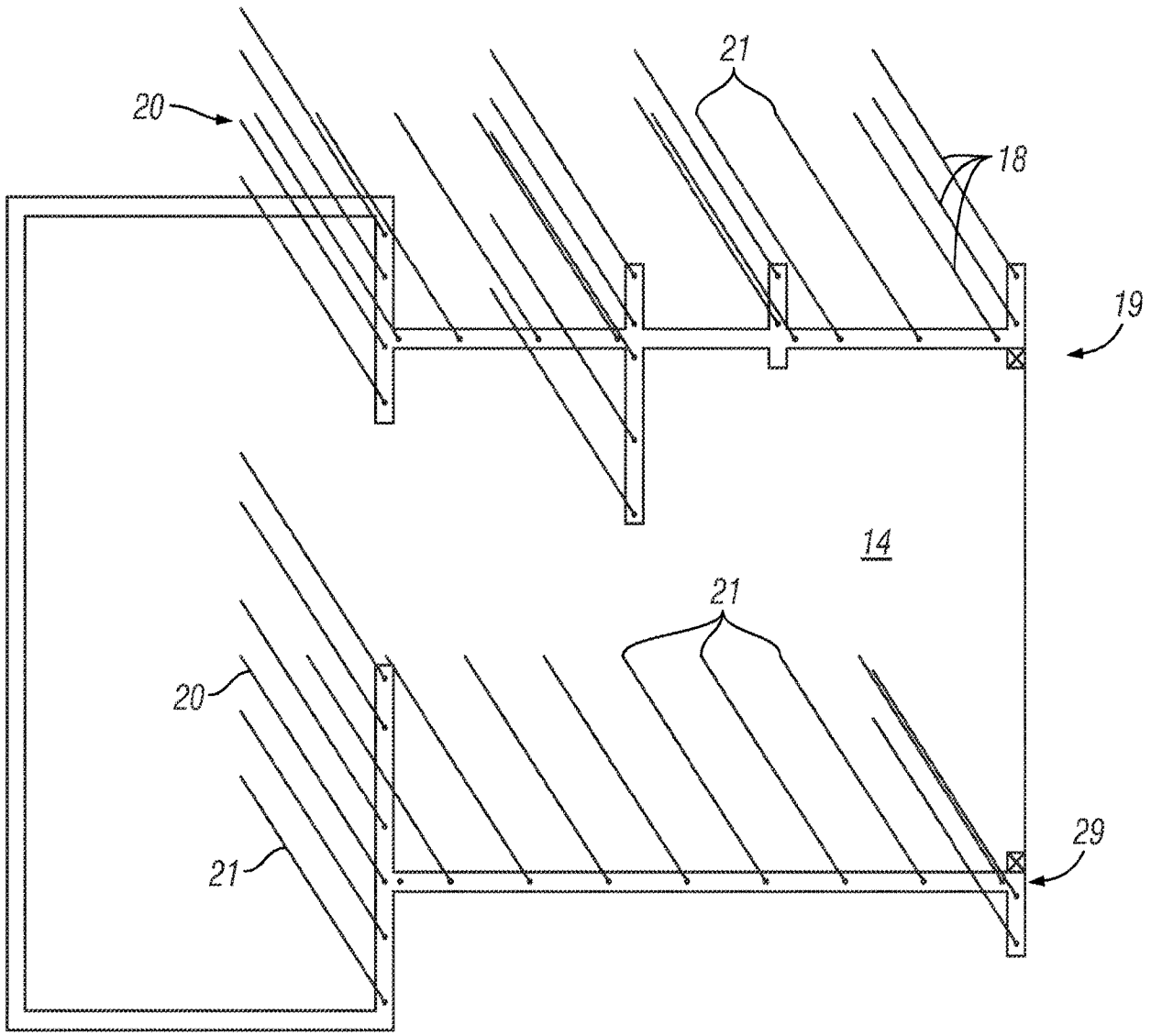
FIG. 2 is a perspective view of a construction site at an early stage, prior to installation of any beams, showing a typical bolting array.

Considering a product (in this case a building or dwelling) constructed in accordance with the above-described method (M) the example dwelling 10 is further explained below. For the purposes of simplified description, and since these are a matter of choice not critical to the invention, most architectural details and all interior details are omitted from the description. The preferred example dwelling (cabin) 10 illustrated in FIGS. 1-4 includes a foundation slab 14, which is carefully aligned to be parallel to the horizontal plane 13. The initial actual construction step (after site and layout and materials selection) in the method (M) is to provide the flat (level) and horizontal (perpendicular to gravitational force) foundation slab 14 with bolt anchor locations 16 in which elongated vertical threaded bolt segments (vertical bolts) 18 are countersunk and secured in precise vertical orientation (see FIGS. 2, 7-9 and 11). The foundation slab 14 is typically poured concrete but other sturdy structural approaches may be used. The vertical bolts 18 are threaded at at least the ends, are held in the bolt anchor locations 16 and are situated in a precise bolt array 19 corresponding to the dwelling design (an example array—not congruent to the example dwelling 10) is shown in FIG. 2). The array 19 includes comer bolts 20 and interstitial bolts 21 situated between comer bolts 20.

A further step in the construction method (M) relates to completing vertical walls mounted upon the vertical bolts 18. For simplicity of explanation, the example cabin 10 is rectangular, but a myriad of other configurations are possible. In the example dwelling 10 illustrated in FIGS. 1, 3, 4, and 6, a set of four exterior vertical walls 22 are provided. A front wall 23 and a rear wall 24 are aligned parallel to the primary vertical plane 11, and consequently with each other. Similarly, a left wall 26 and a right wall 28 are aligned parallel to the transverse vertical plane 12, and to each other. Each of the walls 22 will overlap at opposing ends with the respective perpendicular transverse walls at a comer 29, as described below. Each of the exterior walls 22 is constructed in accordance with the construction method (M).

A roof 30, of generally conventional construction, is mounted on and above the exterior walls 22 as described below. For at least a significant amount of the expanse, an access gap 32 separates the top of each exterior wall 22 from the roof 30 and any other overhead components, as explained below. Various other exterior details, not pertinent to the primary inventive concepts, are also shown and provided. These details include a fireplace 34 with an associated chimney 36, and doors 38 and windows 40 as desired.

The exterior walls 22 of the present invention are constructed with beams 42 as illustrated in more detail in FIG. SA and SB. FIG. SA is a perspective view of an example beam 42 while FIG. SB is a cross sectional view taken along line B-B. The beams 42 are selected to have a beam top 44 and a beam bottom 46 which are flat and parallel to each other, and a pair of beam ends 48. The beams 42 also have beam edges 50 which may also be flat and parallel so that the beam has a rectangular cross section (square, as illustrated in FIG. SB) but may also be beveled or otherwise shaped for aesthetic purposes as these surfaces are not critical to the effectiveness of the construction. In the example dwelling 10 the beams 42 are uniform in cross sectional dimensions, but may vary in thickness as breadth as desired for particular purposes.

Each beam 42 includes series of bolt bores 52 vertically passing therethrough between the beam top 44 and beam bottom 46 surfaces. These bolt bores 52 are strategically spaced and located so as to correspond and mate with the specific bolt array 19. Each bolt bore 52 has a diameter slightly greater than the diameter of the selected vertical bolt segments 18.

Figure 5A:
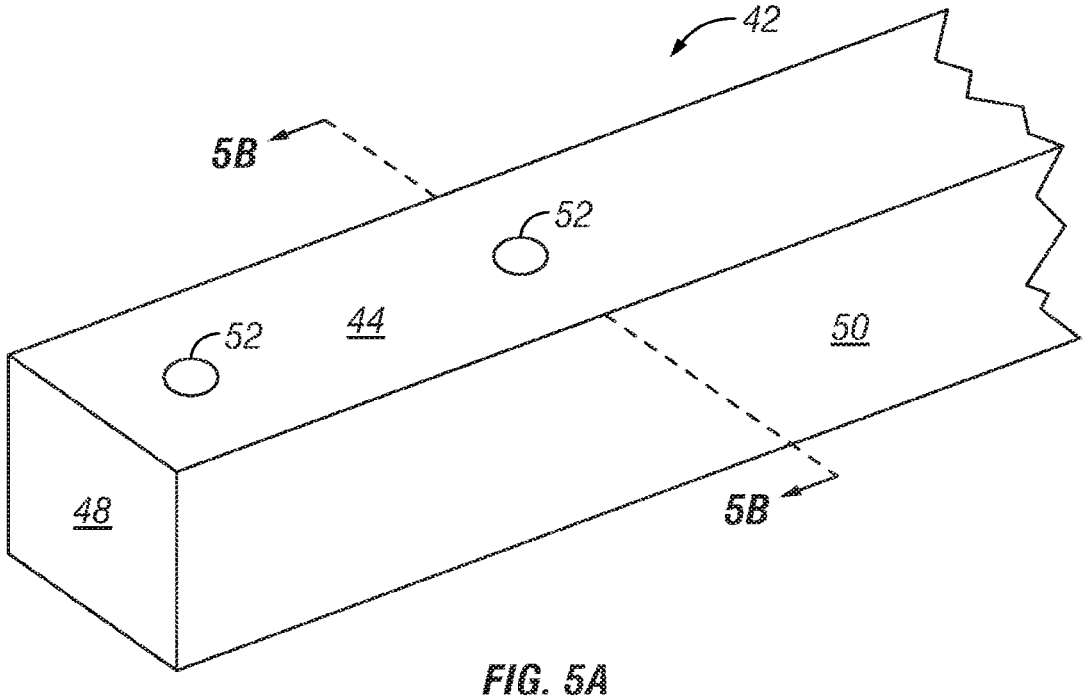
FIG. 5A is a truncated perspective view of an example beam according to the present invention.

Although all of the beams 42 in the example dwelling 10 are substantially similar for the purposes of construction method (M) it is convenient to refer to them separately for the purposes of description. Thus, some beams, which are aligned with the primary vertical plane 11 (e.g. front wall 23 and rear wall 24) are referred to as cross beams 54 while those aligned with the transverse vertical plane 12 (e.g. left wall 26 and right wall 28) are designated as transverse beams 56. An unmodified beam 42 such as is illustrated in FIG. 5A is referred to as a full beam 58, while a beam that is cut short so as to abut against a full beam 58 at a corner 29 is designated as a truncated beam 60. A beam segment 62 is defined as a section of a beam used to fill in gaps in the structure.

As described above in respect to the steps of the preferred method (M) the exterior walls 22 are constructed in a vertically ascending series of layers, as the beams are fitted onto the respective vertical bolts 18. The layers are designated as an odd layer 64 (the lowest of which abuts against the foundation slab 14) and an even layer 66 which rests on top of an odd layer 64 to create a vertical overlap 68 of beams in adjacent layers at each corner 29. The discussion below with regard to FIG. 12 shows four envisioned comer overlap schemes for suitable stable corners 29.

Figure 3:
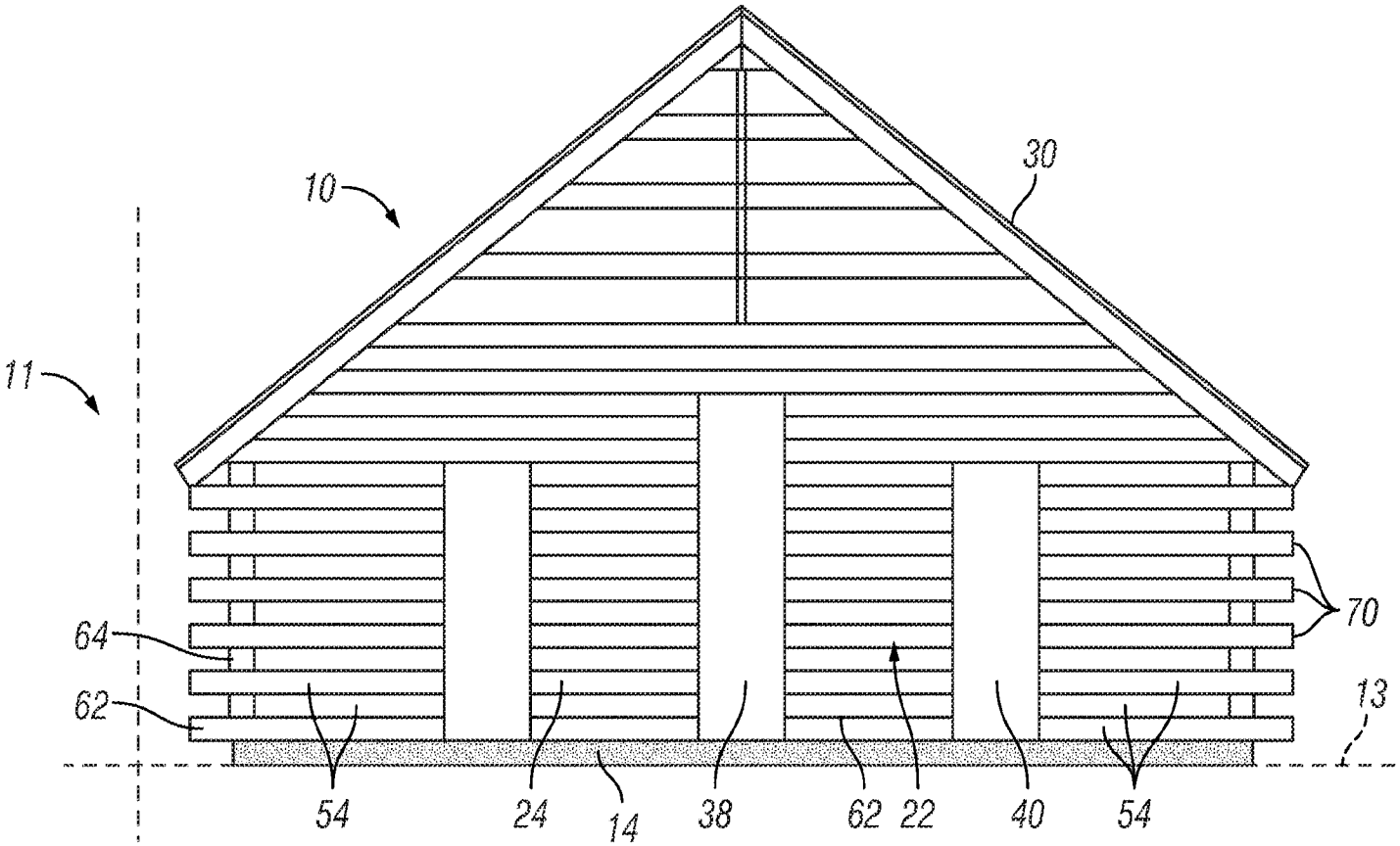
FIG. 3 is a plan view of the left side/end of the example dwelling.
Figure 4:
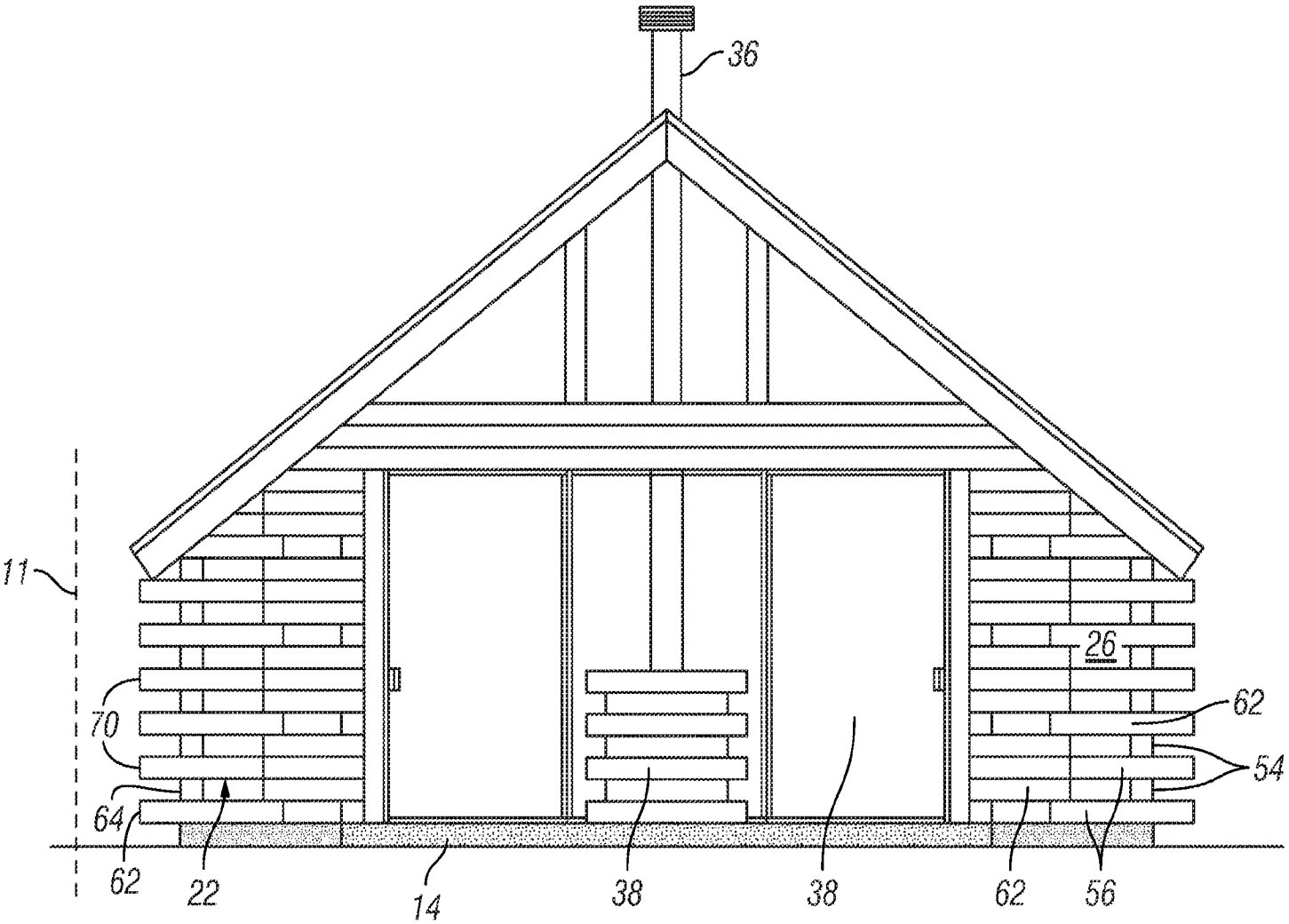
FIG. 4 is a rear plan view of the example dwelling.

For the purposes of description of a preferred embodiment (FIG. 12, depiction D), and referring to the left end of the front wall 23 (and the rear wall 24), the cross beam 54 in an odd layer 64, will be mounted to include a corner bolt 20, as illustrated in FIGS. 3 and 4. In the preferred comer 29 in the example dwelling 10 (as shown in FIG. 10), the cross beam 54 includes an integral extended segment 70 which extends outward beyond the comer 29.

Figure 5B:
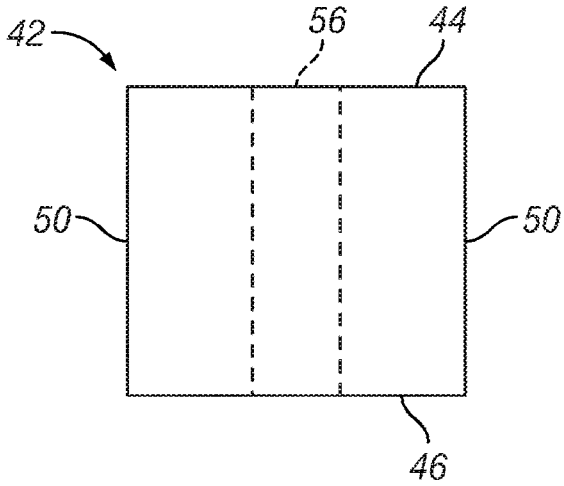
FIG. 5B is a cross sectional view of the beam of FIG. 5A, taken along line B-B.

For the odd layers 64 the transverse beams 56 are truncated beams 60 which are mounted only on interstitial bolts 22 and have one beam end 48 which abuts against a cross beam 54 at each comer 29. For even layers 66, the roles are reversed (see FIGS. 4, 5, and 10) and the transverse beams 56 include extended segments 70 and are mounted to include a corner bolt 20, while the cross beams are truncated beams 60, and are mounted only on interstitial bolts 21.

In order to facilitate construction it is ordinarily necessary to insert bolt couplings 71 at a convenient working height above the foundation slab 14. Workers can usually only effectively lift and position beams 42 on and over the vertical bolt segments 18 to a certain height which is usually consistent with the height of the bolt segment above the foundation slab 14. As the typical threaded bolt segment 18 is about six feet long in US constructions, and since bottom of the lowermost bolt segments is typically embedded about one foot into the foundation slab 14, the most common location to insert a coupling 71, with another bolt segment 18' in the same vertical alignment, will be at a height of about five feet above the foundation slab 14. The upper bolt segment 18' will then extend to slightly above the typical ten foot height of each wall 22, and placement of the beams 14 will then be accomplished with the aid of scaffolding or mechanical lifts, The alternating layers continue until the desired wall height is reached. At this stage rigid washer plates 72 are placed over the elongated bolt 18' and against the top layer of the beams 42. Right angle comer plates 74 are situated on corner bolts 20 to lay against both abutting beams while elongated plates 76 are placed over interstitial bolts 21, preferably extending between two or more interstitial bolts. Nuts 78 are then threaded onto the respective elongated bolts 18' and tightened to the desired pressure levels, forcing the beams against the foundation slab 14 and each other to form a "Bolt-Lam".

Figure 10:
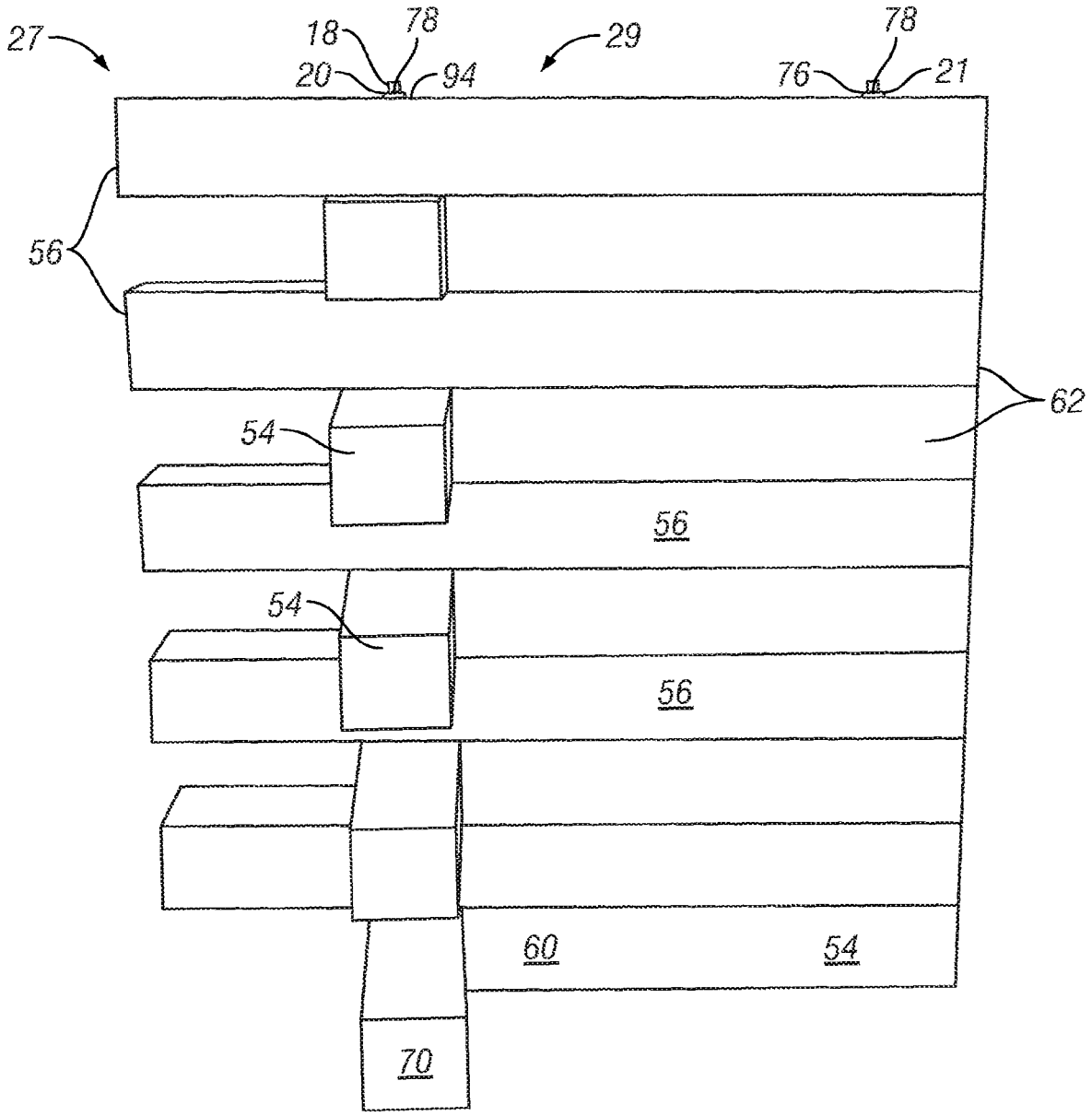
FIG. 10 is a side view of a prototype partial comer section of two very short exterior walls, showing the layering and bolting techniques.
Figure 12B:
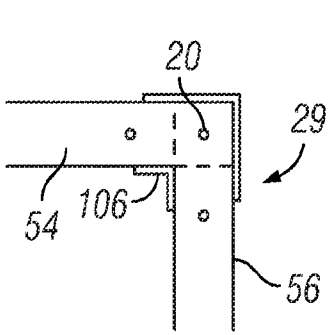
FIG. 12 shows in examples A, B, C, and D, four envisioned comer bracing configurations.
Figure 12A:
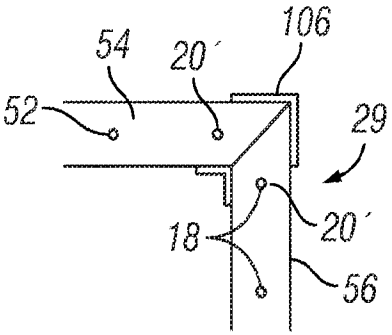
Figure 12D:
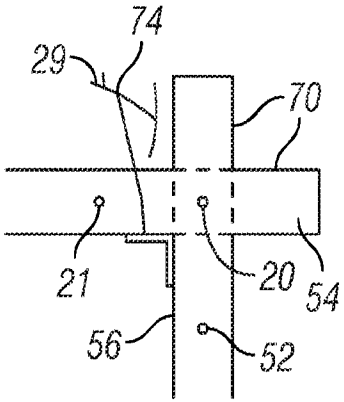
Figure 12C:
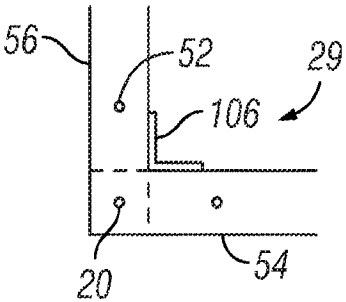

A prototype shortened corner segment of intersecting walls is shown in FIG. 10. This shows the alternating levels, with extended segments 70 at appropriate levels of the cross beam 54 and transverse beam 56, as well as the corresponding abutment of a truncated beam 60 of the respective beam type for each level. Although shown without an elongated vertical bolt 18 anchored in a foundation slab 14 this also shows the washer plate 72 and nut 78 attached to be tightened to force the beams in adjacent layers together.

This prototype (FIG. 10) has been wind-tunnel tested and was shown to successfully withstand gale and hurricane force winds (from many angles and with winds of 50 to 150 mph) without any compromise of integrity.

Figure 8:
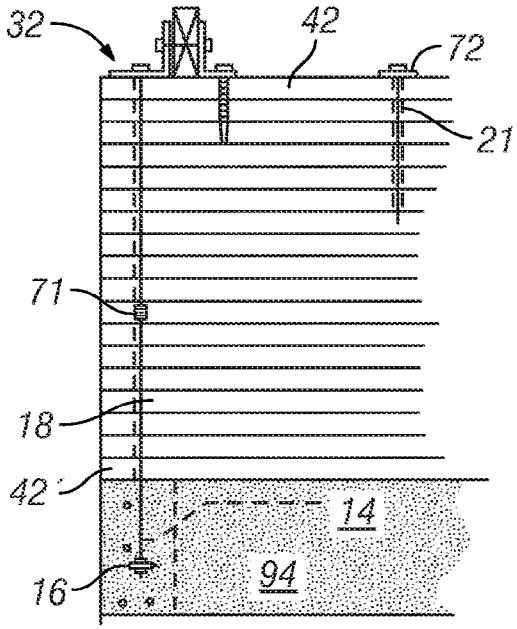
FIG. 8 is a fanciful cross-sectional illustration of a segment of a wall showing an interstitial bolt anchored in the foundation slab and extending upward to pass through the bolt holes in the beams.
Figure 9:
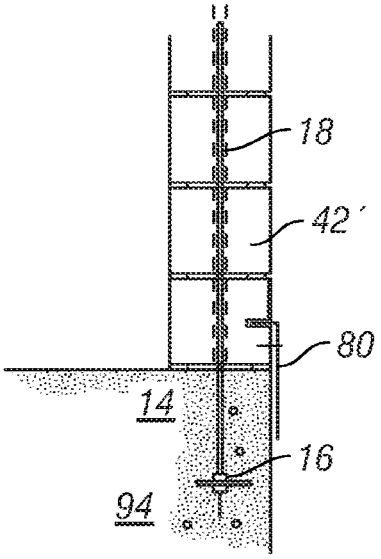
FIG. 9 is a fanciful cross sectional view of a section of the foundation slab, an elongated bolt anchored in the slab and extending through bolt holes, and an alternate washer plate providing an external spacing and securing bracket.

FIGS. 8 and 9 illustrate, in fanciful cross sectional views, the anchoring of elongated bolts 18 in the foundation slab 14 and extending upward through the bolt holes 52 of each beam in the layer. In FIG. 8 an alternate washer plate 72', adapted to connect to an element above the wall, is shown being held in place by a nut 78. In FIG. 9 a spacing/securing bracket 80 is illustrated providing spacing between the foundation slab 14 and the bottom beam 42' and also engaging the bottom beam 42' to hold it securely in position.

Figure 6:
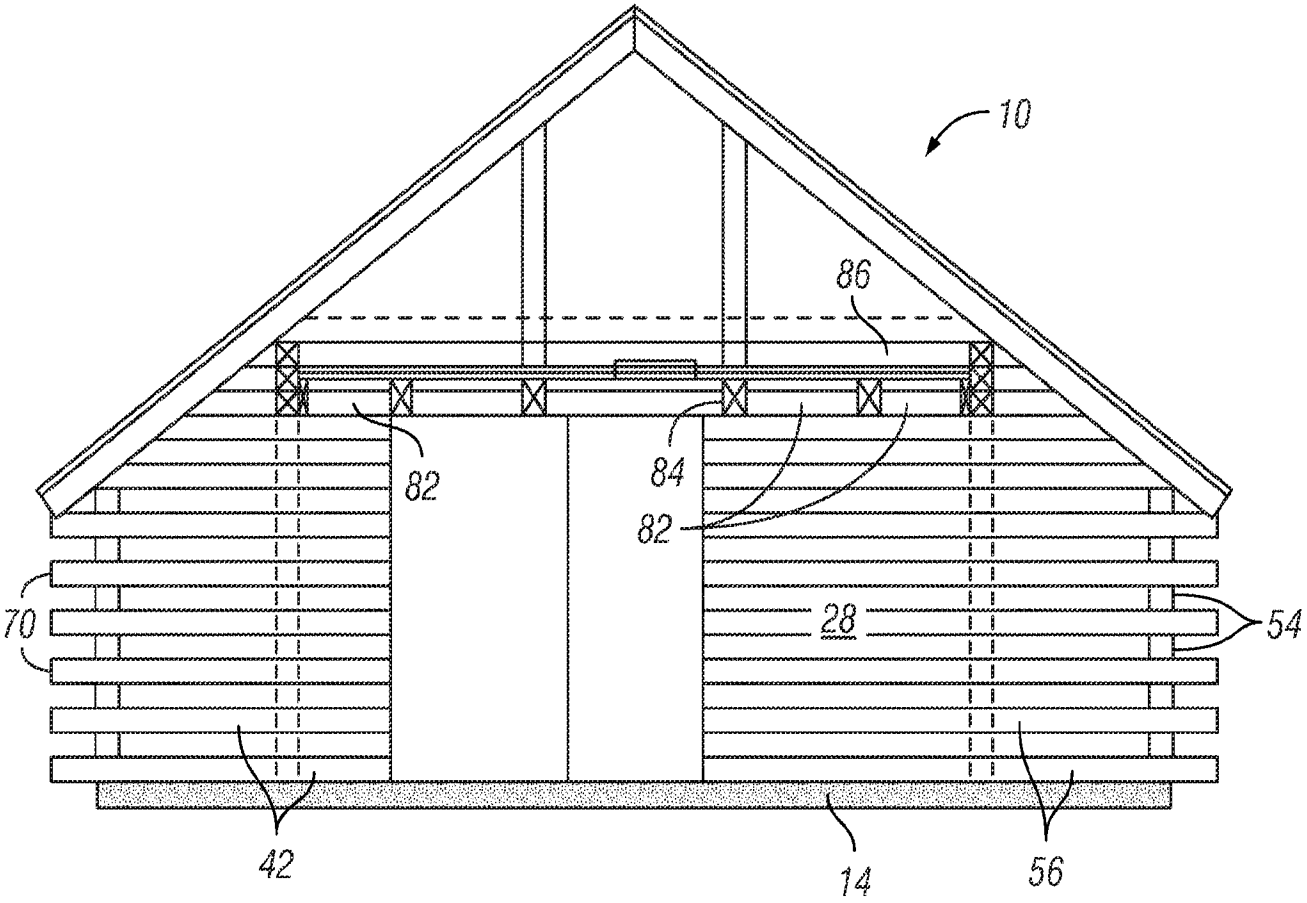
FIG. 6 is a plan view of the right side of the example dwelling, showing a roof mounting approach.
Figure 7:
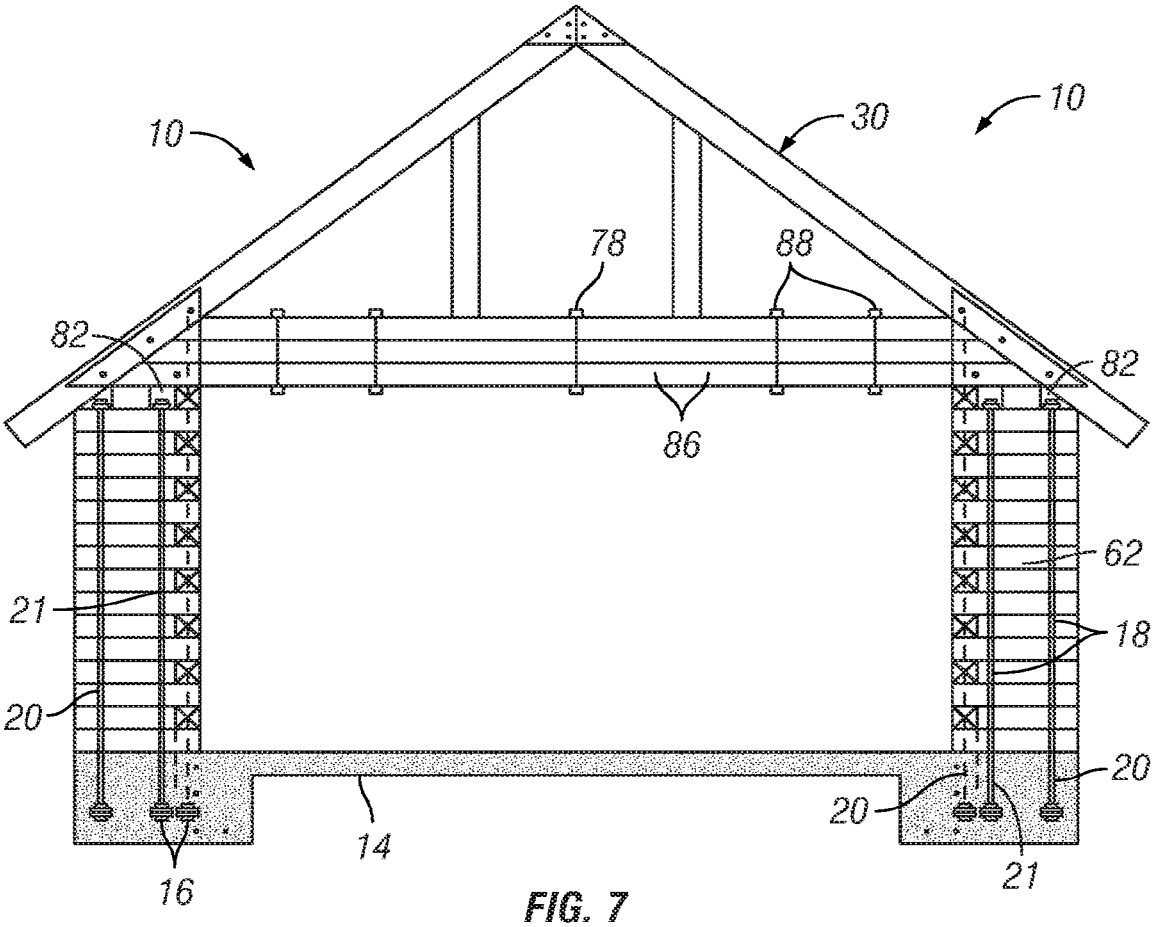
FIG. 7 is cutaway side view of an alternate dwelling, showing another roof mounting approach.

FIGS. 6 and 7 illustrate potential methods/arrangements for mounting a roof 30 onto a dwelling. It is emphasized in method (M) that any roof or ceiling structure requires that an access gap 82 is provided such that each nut 78 may be accessed from inside the structure in order to adjust the pressure level and compensate for the slight material deformations over time. It is also necessary that the roof 30 be secured to the wall structures. In order to typically accomplish this a series of roof spacer blocks 84 (beam segments including bolt bores 52) are placed on top of the wall 22 intermediate the access gaps 82. These roof spacer blocks 84 and rafters 86 and other connective portions of the roof 30 are then secured to the top and potentially lower beams. The securing method includes roof bolting 88 having involving threaded bolt segments 18" with an additional coupling 71 to extend through the upper beams 42 to beyond and through and above the spacer blocks 84 and rafters 86 and provided with washer plates 72 and nuts 78 to tighten the wall and roof elements together in a stable and secure fashion. Depending on the nature of the roof 30, the rafter bolting 88 and roof spacer blocks 84 may only be needed on some of the exterior walls 22.

As other roof construction details are not strictly pertinent to the invention or method (M) these are not addressed herein.

Figure 11B:
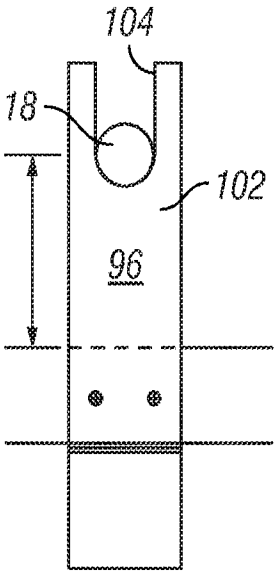
FIG. 11B is a top plan view of a top (or bottom) mounting bracket for the system of FIG. 11A.
Figure 11A:
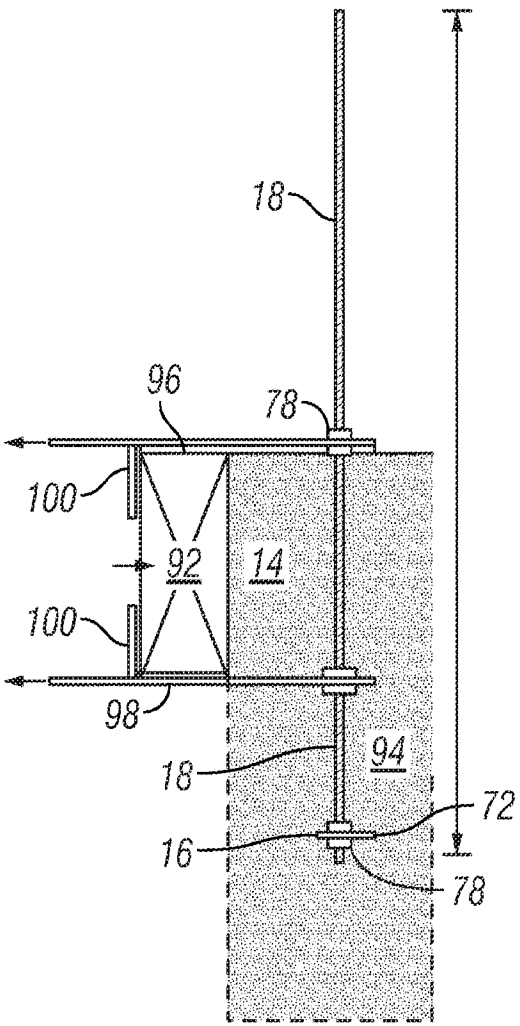
FIG. 11A shows a system for precise anchoring of an elongated threaded bolt in the foundation slab.

FIGS. 11 (A & B) and 12 (A, B, C, and D) show examples of helpful construction details and alternate corner bolting configuration in accordance with the present invention.

FIG. 11 illustrates, both in cut away view (11A) and top view (11B), an alignment system 90 for placing and aligning each bottom vertical bolt 18 in the desired bolt anchor location 16 in the foundation slab 14. Prior to pouring the foundation slab 14, a foundation frame 92 is placed around the desired border. This is typically in the form of a wooden border, in the illustration a 4×8 board. The foundation frame rests outside a foundation cavity 94, into which the concrete or other solid filler will be poured once the bolt array 19 is prepared. A nut 78 is threaded onto the vertical bolt segment above the level of the foundation frame 92, while a further nut 78 and washer plate 72 are situated well below, near the nether end of the bolt segment 18.

A top bracket 96 and a bottom bracket 98 are adapted to fit about the upper and lower surfaces of the foundation frame 92 and extend into the foundation cavity 94. The top bracket 96 and lower bracket 98 each include a right angle flange 100 to abut against the outside of the foundation frame to form a horizontal plate 102, with a centering notch 104 at its interior end in order to receive the bolt segment 18. When the brackets 96 and 98 are properly placed and aligned, the bolt segment 18 is placed to vertically fit into the centering notches 104 of both brackets, with the exterior nut 78 tightened to secure the bolt segment 18 into position and alignment. When all necessary alignment systems 90 are set up around the perimeter (and in portions of the interior when interior walls or the like are included in the plan), the foundation slab 14 may be poured to set each bolt segment into the bolt anchor locations 16 of the array 19. The top bracket 96 and bottom bracket 98 may either be left in place or laterally slid out as the foundation slab hardens.

FIG. 12 shows (in sub-Figures A, B, C, and D) four possible desirable corner 29 structures, each including one or more "L" brackets 106 situated on the interior or exterior angle, or both. In three of the example comers 29 (B, C, and D), the comer bolt 20 extends through the actual comer location and through the alternating layers 64 and 66 of the beams. In the upper right example (FIG. 12A) there are two offset comer bolts 20' passing through respective cross beams 54 and transverse beams 56, each of which is trimmed at a forty-five degree angle so as to abut each other at the apex of the corner 29. The lower left example (FIG. 12D) is the top view of a comer 29 as described above for the example dwelling 10.

The materials selected for the components of the building constructed according to the Method (M) are structurally strong. The preferred foundation slab 14 is poured concrete, but other materials may also suffice. The preferred elongated threaded bolts 18 are formed of construction steel and have dimensions as described above. The preferred beams 42 are selected from stable, yet slightly deformable woods, such as cedar or redwood, while other types of slightly compressible materials, such as synthetic and composite materials, all having compatible upper and lower surfaces, may also be suitable, The beams 42 are most simply elongated and have square cross sections. Uniform thickness of alternating layers is preferred but differing height (thickness) of the layers may be feasible, so long as each layer has a uniform thickness. Bolt hole 52 separation and locations in the beams 42 may be standardized and prefabricated beams 42' may be provided such that onsite drilling is avoided and time is saved.

It is noted that the bolt array 19 defines an exterior frame 108 for the dwelling 10 and the exterior frame 108 defines an interior 110 for the dwelling 10.

Many modifications to the above embodiment may be made without altering the nature of the invention. The dimensions and shapes of the components and the construction materials may be modified for particular circumstances.

While various embodiments have been described above, it should be understood that they have been presented by way of example only, and not as limitations.

INDUSTRIAL APPLICABILITY

The Beam and Bolting Construction Method (M) and the walls and buildings constructed according to the method (M), such as example dwelling 10, according to the present invention are adapted to be constructed precisely and quickly with potentially prefabricated material components, thus greatly enhances the effectiveness of building construction.

Greater effectiveness in cabin and other simple building constructions results in significant economic advantages. In addition, the ability to adjust vertical pressure on the vertical layers in a wall to compensate for deterioration and environmental variations is a significant advantage in minimizing the need to any caulking or other sealing remedies, and is especially effective with redwood materials.

For the above, and other, reasons, it is expected method (M) and products by process 10 according to the present invention will have widespread industrial and construction applicability. Therefore, it is expected that the commercial utility of the present invention will be extensive and long lasting.

The invention claimed is:

1. A beam and bolting structure comprising:

a foundation slab;

a series of spaced-apart vertical bolt segments having lengths embedded in said foundation slab in a predetermined bolt array to extend vertically upward therefrom, each vertical bolt segment in the series of vertical bolt segments having an overall length;

a multiplicity of beam segments with parallel flat top surfaces, parallel flat bottom surfaces and an inside surface, each of the multiplicity of beam segments extending lengthwise between opposite beam ends and having bolt bores extending between said top and bottom surfaces, said bolt bores positioned for fitting over respective ones of said vertical bolt segments, where the parallel flat top surfaces and flat bottom surfaces of the multiplicity of beam segments extend along an entire length of each of the multiplicity of beam segments between the beam ends, where the beam ends terminate at flat planar surfaces perpendicular to and extending between the top surfaces and the bottom surfaces;

where said multiplicity of beam segments are vertically compressible, and are uniformly formed of materials selected from the group consisting of natural wood, cedar, redwood, wood composites, and synthetic materials;

where multiple ones of said multiplicity of beam segments are placed in layers on top of one another over said respective vertical bolt segments to form one or more walls of a desired height including a topmost beam segment of said multiplicity of beam segments having at least one vertical side, and said vertical bolt segments having bolt couplings for extending the overall length of the vertical bolt segments when the desired height of one of said one or more walls exceeds the length of one of the vertical bolt segments, and tightening nuts for applying compression to the topmost of said multiplicity of beam segments;

where multiple ones of said one or more walls form a structure with beam segments of the one or more walls overlapping to form one or more wall corners;

where a subset of said multiplicity of beam segments are designated as cross beam segments, while another subset of said multiplicity of beam segments are designated as transverse beam segments; and where beam ends of said cross beams and said transverse beams meet at said wall corners;

where at said wall corners one of said transverse beam segments lies on top of one of said cross beam segments such that the flat bottom surface of the one of said transverse beam segments contacts the flat top surface of the one of said cross beam segments while in an adjacent one of said layers one of said cross beam segments lies on top of one of said transverse beam segments such that the flat bottom surface of the one of said cross beam segments contacts the flat top surface of the one of said transverse beam segments, thus forming layers of alternating ones of said cross beam segments and transverse beam segments at said wall corners; and wherein in said layers in which one of said transverse beam segments lies on top of one of said cross beam segments, one of the beam ends of said cross beam segment abuts flush against the inside of said transverse beam segment in one of said layers and said transverse beam segment extends across the corner where said cross beam segment and said transverse beam segment meet, while in an adjacent one of said layers, one of the beam ends of said transverse beam segment abuts flush against the inside of said cross beam segment and said cross beam segment extends across the corner where said transverse beam segment and cross beam segment meet; and wherein said predetermined bolt array includes corner bolts which pass through only one of said alternating cross beams and transverse beams at each of said layers in each of said corners.

2. The bolt and beam structure of claim 1, wherein the corner bolts in said predetermined bolt array and said tightening nuts are configured to compress said alternating beam segments together by tightening said tightening nuts.

3. The bolt and beam structure of claim 1, wherein the beam and bolting structure includes a roof extending over one or more of the walls, and an access gap is provided above each of said tightening nuts and below trhe roof, which said access gap is accessible from an outside of a vertical side of the one or more walls such that said tightening nuts may be adjusted.

4. The bolt and beam structure of claim 1, wherein said tightening nuts are tightened so that said multiplicity of beam segments in each of the one or more walls is compressed together such that each of said one or more walls functions as a single unit.

5. A rectangular cabin dwelling structure, comprising:

a flat level foundation slab;

a predefined bolt array including a plurality of spaced-apart vertically aligned threaded bolts having a diameter and which are embedded and secured in said foundation slab, said bolt array defining an exterior frame having a plurality of corners and an enclosed interior;

a plurality of beam segments, each of said plurality of beam segments having an inner surface and a flat top surface and a parallel flat bottom surface adapted to abut flushly against a top and a bottom surface of vertically adjacent ones of said plurality of beam segments, each of the plurality of beam segments extending lengthwise between opposite beam ends, each of said plurality of beam segments further including spaced-apart bolt bores extending vertically therethrough, said bolt bores corresponding to spacing of said spaced-apart vertically aligned threaded bolts in said bolt array and which said bolt bores have a diameter exceeding a diameter of said threaded bolts, where the parallel flat top surfaces and flat bottom surfaces of the multiplicity of beam segments extend along an entire length of each of the plurality of beam segments between the beam ends, each beam end terminating at flat planar surfaces perpendicular to and extending between the flat top surfaces and the flat bottom surfaces; and securing nuts for mating with said vertically aligned threaded bolts and washers for said securing nuts; wherein said plurality of beam segments are vertically stacked in layers with corresponding ones of said vertical bolts extending through corresponding bolt bores in each said beam segment to form one or more vertical walls, each of the vertical walls including an uppermost beam segment of said plurality of beam segments having at least one vertically-oriented side and a top;

said washers having a horizontal extent exceeding the diameters of said respective bolt bores such that when said securing nuts are tightened said washers apply pressure to force said layers together; and wherein multiple ones of said vertical walls meet to form one or more of said corners;

wherein said layers of beam segments include alternating odd layers and even layers;

said layers of beam segments include ones of said beam segments identified as cross beams and transverse beams, each of the beam segments having an end;

at each of said one or more corners said bolt array includes one of said vertical bolts designated as a corner bolt;

at a corner of each odd layer said cross beam extends across said corner, and said corner bolt extends through said cross beam, while the end of said transverse beam abuts flush against an inside of said cross beam; and at a corner of each even layer said transverse beam extends across said corner, and said corner bolt extends through said transverse beam while the end of said cross beam abuts flush against an inside of said transverse beam;

wherein at each said layer in each said corner, each of said corner bolts passes alternately through one of said cross beams or one of said transverse beams.

6. The rectangular cabin dwelling structure according to claim 5 and further comprising:

a roof extending over said enclosed interior; wherein an access gap is provided at the top of each said wall over each of said securing nuts such that after construction each of said securing nuts may accessed from an interior side of the uppermost beam segment to adjust a pressure applied by said securing nut to said washer.

7. The rectangular cabin dwelling structure of claim 5 wherein access to said interior is provided by utilizing truncated beams in selected locations and layers in said walls to facilitate openings for doors and windows.

* * * * *